United States Patent [19]

Hiett

[11] Patent Number: 5,076,139

[45] Date of Patent: Dec. 31, 1991

[54] BUFFER FOR FIREARMS

[76] Inventor: Charles A. Hiett, 18 Starlifter T C, McGuire AFB, N.J.

[21] Appl. No.: 575,399

[22] Filed: Aug. 29, 1990

[51] Int. Cl.[5] ..... F41A 5/04

[52] U.S. Cl. ..... 89/198

[58] Field of Search ..... 89/198, 196, 163

[56] References Cited

U.S. PATENT DOCUMENTS

| | | | |
|---|---|---|---|
| 1,563,675 | 12/1925 | Tansley | 89/198 |
| 2,522,192 | 9/1950 | Porter | 42/1.06 |
| 3,115,063 | 12/1963 | Browning | 42/1.06 |
| 3,756,121 | 9/1973 | Roy | 89/196 |
| 3,869,961 | 3/1975 | Kawamura | 89/198 |
| 3,886,844 | 6/1975 | Kepplinger et al. | 89/198 |
| 3,901,125 | 8/1975 | Raville | 89/198 |
| 4,344,352 | 8/1982 | Yates et al. | 89/198 |
| 4,514,921 | 5/1985 | Burkleca | 42/1.06 |
| 4,522,107 | 6/1985 | Woodcock et al. | 89/198 |
| 4,715,140 | 12/1987 | Rosenwald | 89/14.3 |
| 4,754,689 | 7/1988 | Grehl | 89/198 |

*Primary Examiner*—Michael J. Carone

*Attorney, Agent, or Firm*—Dann, Dorfman, Herrell & Skillman

[57] ABSTRACT

A conventional Beretta-type pistol is shown, having a recoil spring (26) compressed between the front of the slide (14) and a seat (28) at the rear of the guideway (13) in which the slide is displaceable. A buffer (32) is dimensioned to span across adjacent convolutions of the recoil spring (26) for slidable adjustment along the spring and has an outline complementary to the interior (18) of the slide (14) so that it may self-adjust. The buffer (32) cushions the impact of the slide abutment (22) against the frame buttress (24) and the barrel lug (16).

10 Claims, 2 Drawing Sheets

BUFFER FOR FIREARMS

FIELD OF THE INVENTION

The present invention relates to pistols and is particularly applicable to pistols used for competitive target shooting and those pistols exposed to rigorous training requirements.

BACKGROUND OF THE INVENTION

In firing pistols, the action slide during recoil abuts against the frame buttress resulting in hammering and vibrations. As a consequence, particularly in target pistols and training pistols which fire thousands of rounds, the pistol is prone to develop stress cracks in the slide and frame and/or metal fatigue in the slide and frame.

Various damping devices and mechanisms have been developed for such firearms, but most of such devices complicate the mechanism of the firearm and cause maintenance problems.

A simple solution for many pistols is the provision of a buffer which is a cushioning pad positioned between the recoil spring and the frame, particularly between the recoil spring and the backing flange for the spring, to cushion the impact of the slide at the end of its travel when the spring is fully compressed. The use of a buffer of this character has proved to be highly effective and yet inexpensive because of the ability to easily replace the buffer in normal maintenance operations.

In a Beretta pistol and in other pistols having a similar configuration, the action slide abuts the frame buttress around an aperture through which the recoil spring penetrates, being seated at one end against the slide and seated at the other end against a guide rod which abuts the frame at the other side of the buttress. In such pistols, positioning a buffer at either end of the spring does not function to cushion the impact of the slide against the frame.

SUMMARY OF THE PRESENT INVENTION

The present invention provides a buffer for use with firearms in which the action slide is designed to impinge against a buttress having an aperture through which the recoil spring penetrates.

More specifically, the present invention provides a buffer element which may be mounted to encircle the recoil spring so as to position itself between the action slide and the buttress.

The present invention provides a buffer element which slideably engages the recoil spring so as to enable itself to self-adjust its position on the spring and accommodate to changing tension conditions in the spring and compensate for variable operating conditions of the mechanism.

The buffer element of the present invention is designed to be mounted for axial adjustment within the housing for the slide abutment so as to enable the buffer to be displaced within the housing with extension and contraction of the recoil spring.

BRIEF DESCRIPTION OF THE DRAWINGS

All of the objects of the invention are more fully set forth hereinafter with reference to the accompanying drawing, wherein.

DESCRIPTION OF A PREFERRED EMBODIMENT

Figure 1:
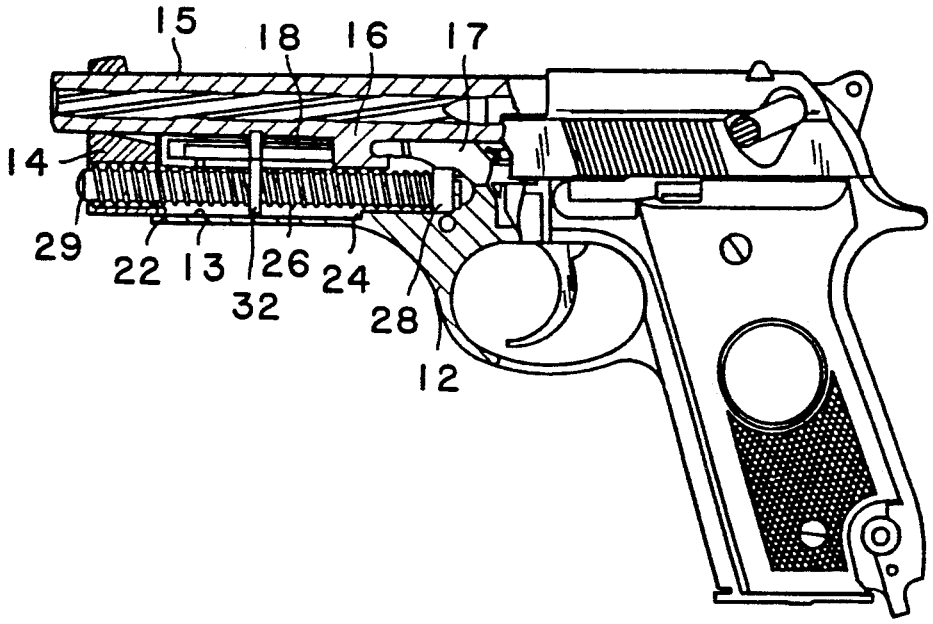
FIG. 1 is a view in side elevation of a pistol in the pre-firing position with portions broken away to illustrate the position of the action slide, the recoil spring and its guide rod.
Figure 2:
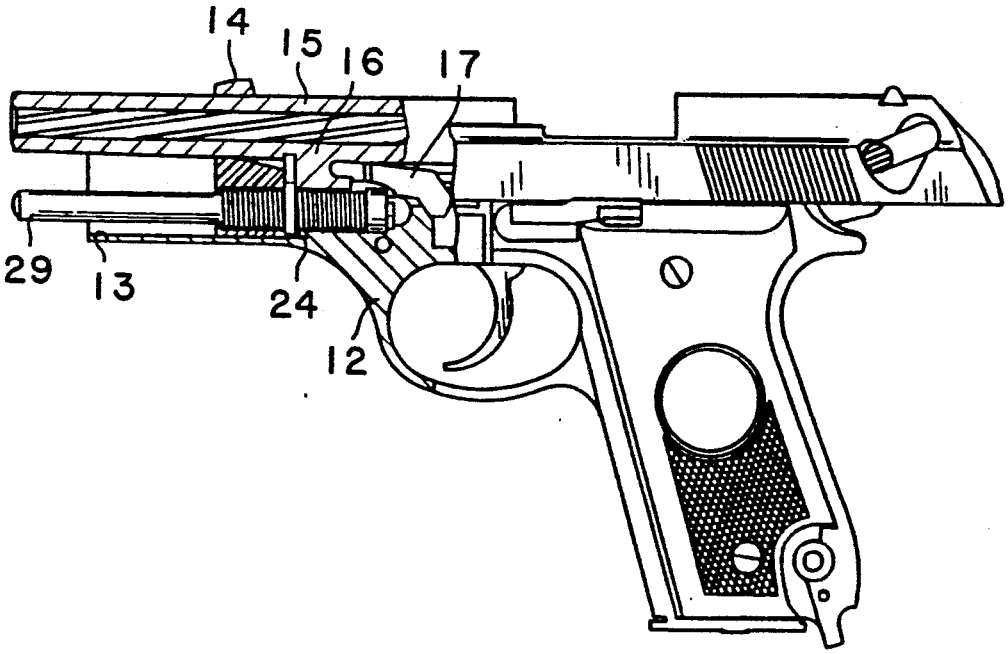
FIG. 2 is a view similar to FIG. 1 showing the pistol after firing at the end of its recoil.

A Beretta-type pistol is illustrated in FIG. 1 and comprises a frame 12 having a guideway 13 in which a slide is displaceable. The slide, in turn, mounts a barrel 15, and the barrel has a depending lug 16 which cooperates with a latching mechanism 17 at the rearward end of the guideway 13 for operating the normal automatic functions at the end of the recoil after firing. The interior of the slide 14 has a grooved configuration, as indicated at 18, to slidably receive the lug 16 for relative displacement parallel to the axis of the barrel 15. At the front end of the slide, the slide forms an abutment 22 which is slidable in the guideway 13 during the recoil movement. As shown in FIG. 2, after firing, the slide 14 is retracted to engage against the front face of the lug 16 and to drive the barrel 15 rearwardly to actuate the latch mechanism 17.

In the present embodiment of the invention, the frame 12 of the pistol has a buttress at 24 to stop the recoil travel of the slide 14. The buttress 24 comprises a shoulder which is positioned in the path of the slide abutment 22 such that when the slide travels to the right, as shown in FIG. 2, the abutment 22 is stopped by the buttress 24. The recoil movement of the slide is yieldingly resisted by a recoil spring 26 mounted in the guideway 13. At its forward end, the spring engages the front part of the slide 14, and at its rearward end, the spring engages a seat 28 positioned at the rearward end of the guideway 13. The spring 26 is a compactible coil spring having a series of convolutions formed of spring wire and, when mounted, it is slightly compressed between the seat 28 and the front part of the slide 14. The seat 28 is provided with a forwardly-projecting guide pin 29 which passes through the center of the convolutions of the spring 26 to maintain alignment of the convolutions during compaction and extension of the spring. When the pistol is fired, the recoil action by the slide 14 is yieldingly resisted by the spring 26 which is compacted as the front part of the slide 14 retracts in the guideway 13 until the travel of the slide is arrested by the buttress 24 which is positioned forwardly of the seat 28 within the guideway 13. It is noted that the spring is seated at its forward end in the front part of the slide 14 and extends rearwardly past the barrel lug 16 and the buttress 24 to the seat 28 at the rear end of the guideway 13. As described thus far, the pistol shown in FIGS. 1 and 2 is of conventional design.

Figure 3:
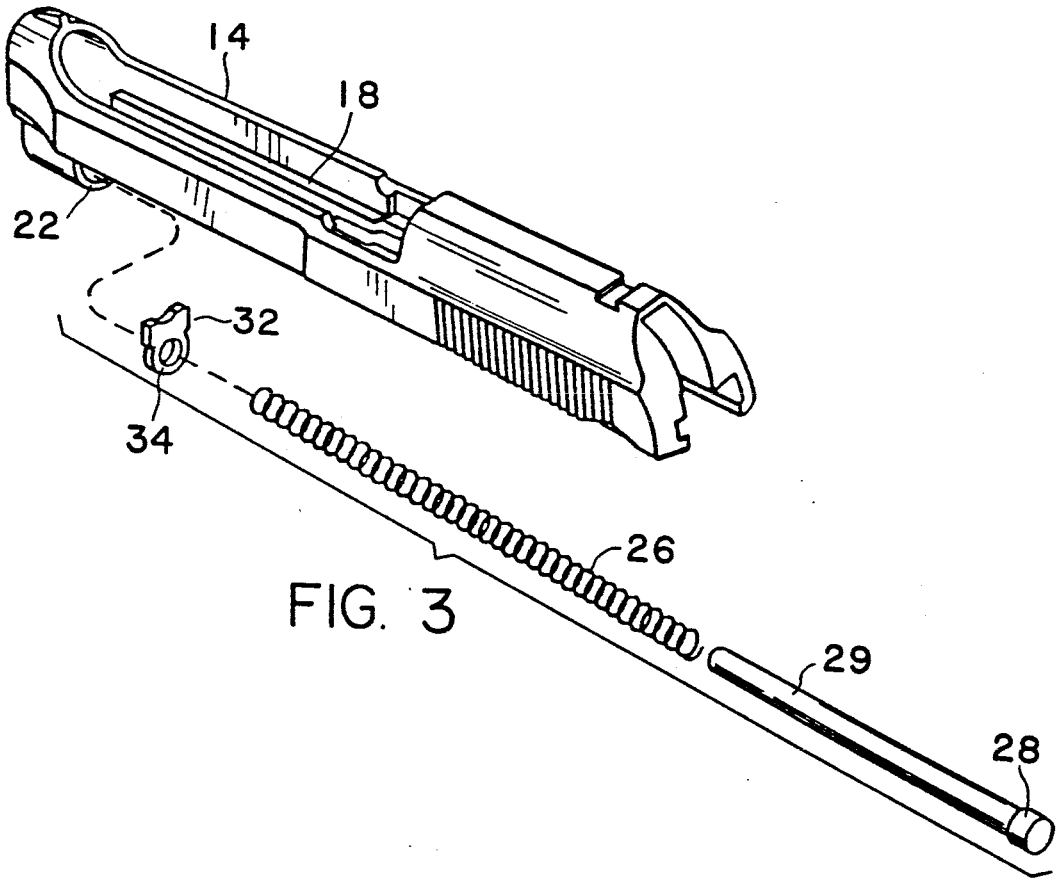
FIG. 3 is a exploded view of the slide, buffer, recoil spring and guide rod removed from the frame.

The present invention provides a facile manner to cushion the impact of the slide abutment 22 against the frame buttress at 24 and against the barrel lug 16. To this end, a buffer element 32 is mounted in the guideway 13 so as to slide within the grooved interior of the slide 14. As shown in FIG. 3, the buffer 32 has a configuration complementary to the configuration of the grooves 18 in the slide so that the buffer 32 is free to slide within the grooves 18 parallel to the axis of the barrel 15. In the present instance, the buffer 32 has a central aperture 34 which is cylindrical in form and has a diameter operable to slide along the outside of the convolutions of the spring 26 as the spring is either compacted or extended.

In the present instance, the buffer element 32 is a flat annular element made of a polymeric material so as to be resilient and to serve as a proper cushioning element between the slide abutment 22 and the buttress 24. Preferably, the element has a durometer of approximately 90-A and a preferred polymer is polyurethane; however, other elastomeric materials may be found suitable. The thickness of the buffer is sufficient to span across adjacent convolutions of the spring 26 when the spring is in extended position. In this fashion, the cylindrical aperture 34 within the buffer 32 bridges the convolutions and enables the buffer element to be freely displaced axially along the length of the spring 26. In the present instance, the thickness of the buffer is in the range of 0.090" to 0.165" which is sufficiently thick to span across adjacent convolutions of the spring and yet not so thick as to inhibit sliding movement of the buffer on the outside of the spring convolutions.

Thus, in operation of the pistol with the buffer 32 in place on the spring 26, the buffer 32 is positioned between the abutment 22 of the slide and the frame buttress at 24 and the barrel lug at 16. The resilient nature of the material of the buffer 32 cushions the impact at the end of the recoil and thereby reduces the stresses imparted to the frame and the slide and consequently reduces the tendency of these components of the pistol to develop stress cracks. By mounting the buffer on the outside of the spring convolutions, the buffer self-adjusts its longitudinal position to assure that the movement of the slide abutment 22 against the buffer compresses the buffer against the front surfacer of the barrel lug 16 and the forwardly-facing surface of the buttress 24. It has been found that the buffer of the present invention sustains its cushioning effect after firing over 1000 rounds and is capable of accommodating to variations in the spring tension which may occur over prolonged use of the pistol. When the pistol is disassembled for its normal cleaning and maintenance operations, it is a simple procedure to inspect the buffer and replace it if it appears that the buffer is subject to damage or loss of resiliency. The buffer is simply slid endwise from the spring 26, and a replacement buffer is positioned on the spring. During firing of the pistol after the new buffer is in place, the buffer adjusts itself longitudinally of the spring 26 to find the proper position in the guideway 13.

The buffer of the present invention is particularly applicable to target pistols used in competition and those pistols that are used in police or military training environments, since such pistols are normally subjected to firing of thousands of rounds, both in practice and in competition, as opposed to the use of pistols in security work where it may be months or even years before the pistol is fired other than in practice.

The invention has been illustrated in connection with a Beretta-type pistol, but the invention is equally applicable to all types of firearms in which there is a recoil spring having its opposite ends seated at a distance from a buttress or lug against which the slide abutment is stopped. Variations in the configuration in the outline of the buffer may be made to accommodate to the interior configuration of the guideway in which the buffer may be displaced, and the aperture of the buffer may be sized to slidably engage the outside diameter surface of the recoil spring. Other changes and modifications may be made in and to the invention within the scope of the following claims.

I claim:

1. A firearm having a barrel, a slide, a frame and a recoil spring compressed between a front part of the slide and the frame, said barrel and slide being displaceable rearwardly axially of said barrel against the bias of said recoil spring upon firing the firearm, said frame having a guideway parallel to the barrel axis slidably receiving the front part of said slide and accommodating said spring for compaction and extension upon rearward and forward displacement respectively of said slide, said guideway having at its rearward end seat means mounting the rearward end of said spring and having a buttress forwardly of said rearward end in the path of said slide front part to stop the rearward displacement of said slide in said guideway, said barrel having a lug depending into said guideway adjacent said buttress for displacement therein with said axial displacement of the barrel, said slide having longitudinal groove means of a configuration to slidably engage said lug during retraction of said slide, said spring extending in said guideway rearwardly from said front part, past said lug and said buttress, to said rearward end, said firearm including a buffer element having a configuration complementary to said groove configuration to enable sliding displacement of said buffer element within said groove means, said buffer element encircling said spring in said guideway between said front part and said lug and said buttress, whereby upon retraction of said slide, said front part engages the front of said buffer element and compresses the element against the front of said lug and the front of said buttress.

2. A firearm having a barrel, slide, a frame and a recoil spring compressed between a front part of the slide and the frame, said barrel and slide being displaceable rearwardly axially of said barrel against the bias of said recoil spring upon firing the firearm, said frame having a guideway parallel to the barrel axis slidably receiving the front part of said slide and accommodating said spring for compaction and extension upon rearward and forward displacement respectively of said slide, said guideway having at its rearward end seat means mounting the rearward end of said spring and having a buttress forwardly of said rearward end in the path of said slide front part to stop the rearward displacement of said slide in said guideway, said barrel having a lug depending into said guideway adjacent said buttress for displacement therein with said axial displacement of the barrel, said spring extending in said guideway rearwardly from said front part, past said lug and said buttress, to said rearward end, said firearm including a buffer element encircling said spring in said guideway between said front part and said lug and said buttress, whereby upon retraction of said slide, said front part engages the front of said buffer element and compresses the element against the front of said lug and the front of said buttress, said buffer comprising a flat annular element of a given thickness having a cylindrical opening therethrough, and said recoil spring comprises a compactible coil spring having a series of convolutions formed of spring wire, in the extended position of said spring said convolutions being spaced apart a distance less than the thickness of said buffer element, in the compacted position of said spring said convolutions having an outer diameter slidable in the cylindrical opening of said element.

3. A firearm according to claim 2 wherein said buffer element comprises a resilient polymeric material having a durometer of approximately 90-A.

4. A firearm according to claim 2 wherein said given thickness of the element is in the range of 0.090 to 0.165 inches.

5. A firearm according to claim 2 wherein said seat means includes a guide pin projecting forwardly through the convolutions of said coil spring to maintain alignment of the spring convolutions during compaction and extension of said spring.

6. A firearm according to claim 2 wherein said slide has longitudinal groove means of a configuration to slidably engage said lug during retraction of said slide, said buffer element having a configuration complementary to said groove configuration to enable sliding displacement of said buffer element within said groove means.

7. For use with a firearm having a barrel, a slide, a frame and a recoil spring comprising a compactible coil spring having a series of spring-wire convolutions compressed between a front part of the slide and the frame, said barrel and slide being displaceable rearwardly axially of said barrel, said recoil spring being operable to be compacted by rearward displacement of said slide to yieldingly resist such displacement upon firing the firearm, said frame having a guideway parallel to the barrel axis slidably receiving the front part of said slide and accommodating said spring for compaction and extension upon rearward and forward displacement respectively of said slide, said guideway having at its rearward end seat means mounting the rearward end of said spring and having a buttress forwardly of said rearward end in the path of said slide front part to stop the rearward displacement of said slide in said guideway, said barrel having a lug depending into said guideway adjacent said buttress for displacement therein with said axial displacement of the barrel, and said slide having a grooved configuration to slidably engage said lug during rearward displacement of said slide relative to said barrel, said spring extending in said guideway rearwardly from said front part, between said lug and said buttress, to said rearward end, and being operable to extend and displace said slide forwardly, in said extended position the spring-wire convolutions being spaced apart a given distance, a buffer element adapted to encircle the spring in the guideway between the front part and the lug and the buttress, whereby upon retraction of the slide, the front part engages the front of said buffer element and compresses the element against the front of the lug and the front of the buttress, said buffer element comprises a flat annular element having an outline complementary to the grooved configuration of the slide and a cylindrical central opening operable to slide on the convolutions of the spring when compacted, and having a thickness greater than the spacing of the convolutions in the extended position of the spring.

8. A buffer element according to claim 7 wherein said buffer element comprises a resilient polymeric material having a durometer of approximately 90-A.

9. A buffer element according to claim 7 wherein said given thickness of the element is in the range of 0.090 to 0.165 inches.

10. For use with a firearm having a barrel, a slide, a frame and a recoil spring comprising a compactible coil spring having a series of spring-wire convolutions, compressed between a front part of the slide and the frame, said barrel and slide being displaceable rearwardly axially of said barrel, said recoil spring being operable to be compacted by rearward displacement of said slide to yieldingly resist such displacement upon firing the firearm, said frame having a guideway parallel to the barrel axis receiving said slide and said spring, said barrel having a lug depending into said guideway, and said slide having a grooved configuration to slidably engage said lug, said spring being operable to extend and displace said slide forwardly, in said extended position the spring-wire convolutions being spaced apart a given distance, an annular buffer element comprising a resilient polymeric material adapted to encircle the spring in the guideway between the front part and the lug and the buttress, whereby upon rearward displacement of the slide it engages said buffer element and compresses the element against the lug, said buffer element comprising a flat annular element having an outline complementary to the grooved configuration of the slide and a cylindrical central opening operable to slide on the convolutions of the spring when compacted, and having a thickness greater than the spacing of the convolutions in the extended position of the spring.

* * * * *